United States Patent [19]

Watson

[11] Patent Number: 4,721,235

[45] Date of Patent: Jan. 26, 1988

[54] TANK FOR TRANSPORT AND STORAGE OF SEMISOLID AND FLUID MATERIALS

[76] Inventor: M. Burnell Watson, Box 34, Dorsey, Ill. 62021

[21] Appl. No.: 894,952

[22] Filed: Aug. 8, 1986

[51] Int. Cl.[4] ..... B67D 5/42

[52] U.S. Cl. ..... 222/389; 277/34; 384/42

[58] Field of Search ..... 222/389, 386, 326; 277/34, 34.2, 34.6, 226; 384/15, 32, 42; 92/128; 187/95; 220/81 R, 239, 240

[56] References Cited

U.S. PATENT DOCUMENTS

| | | | |
|---|---|---|---|
| 1,892,519 | 12/1932 | Schottgen | 222/389 |
| 2,559,564 | 7/1951 | Sperling | 277/34 |
| 3,113,705 | 12/1963 | Weitzel | 222/389 |
| 3,203,674 | 8/1965 | Watson | 277/34 |
| 3,321,110 | 5/1967 | Price | 222/389 |
| 3,690,742 | 9/1972 | Sang | 384/42 |
| 3,828,988 | 8/1974 | Berry | 222/389 |
| 3,940,152 | 2/1976 | Fournier | 277/34 |
| 4,632,281 | 12/1986 | Wold | 222/389 |

*Primary Examiner*—F. J. Bartuska
*Assistant Examiner*—Kenneth Noland
*Attorney, Agent, or Firm*—Senniger, Powers, Leavitt and Roedel

[57] ABSTRACT

An elongate tank for transport or for storage in bulk of semisolid and fluid materials, such as grease and oil. This tank has an outlet for the material contained therein at one end thereof, and is of generally cylindric interal cross section. It has a generally cylindric piston sized to slide therein, which is adapted to be moved in a direction toward the outlet, thereby forcing the material in the tank through the outlet. An elastic annular seal is carried in a circumferential channel around the piston adjacent one end of the piston. The seal is hollow and expandable and has a pressurizing device for varying the pressure within the seal between atmospheric pressure and a pressure higher than atmospheric wherein the seal expands and presses against the internal surface of the tank with the pressure such that when the piston slides in the tank the seal is maintained in sliding engagement with the internal surface thereby to wipe the material therefrom and to seal the piston relative to the tank. The piston is held against canting in the tank by a plurality of pads fastened to the piston and extending radially outwardly therefrom beyond the periphery of the piston for engagement with the internal surface of the tank. The pads are of low friction material to permit the piston to slide freely in the tank, and they are spaced axially of the piston from the seal a distance sufficient to prevent canting of the piston.

13 Claims, 3 Drawing Figures

1
3
5
7
9
11
13
15
17
19
20
23
25
27
28
29
31
33
T
D
W
SW
C

TANK FOR TRANSPORT AND STORAGE OF SEMISOLID AND FLUID MATERIALS

BACKGROUND OF THE INVENTION

This invention relates generally to a system for transporting or storing semisolid materials, such as grease or ground or comminuted food products, and fluid materials, such as oil, in bulk quantities, and more particularly to a tank adapted for quickly and efficiently unloading semisolid or fluid material contained therein.

Coassigned U.S. Pat. No. 3,828,988 discloses an earlier tank for bulk transport and storage of semisolid materials. This tank has a follower piston with extruded or molded flexible neoprene seals at each end thereof for sealing the piston relative to the tank while accommodating changes in internal cross-section of the tank (variations of as much as ¼ in. (8 mm) in diameter), and spring-biased nylon rollers for preventing canting of the piston as it moves within the tank. Although this tank performs well, and the neoprene seals provide an effective wiping action of the tank interior, thin smears or patches of grease sometimes remain on the inside surface of the tank after evacuation. While this is satisfactory for many purposes, it is not acceptable for all purposes, e.g., where the tank is to be loaded with a different type of grease after unloading and contamination of the second type of grease with the former type is not permissable, or where the tank is to.be loaded with comminuted food products. Also, the earlier tank follower has numerous parts and is relatively costly to fabricate and somewhat difficult to assemble and insert into the tank.

Heretofore, ground food products have not commonly been transported in bulk due to the difficulty or impossibility of maintaining a high standard of cleanliness and sterility in a transport tank. In lieu of bulk transport, other, less desirable, forms of transport have been used. These methods of transport typically have been expensive and time consuming. For example, in the processing of chicken, raw backs and wings are conventionally ground and transported several hundred miles for processing into frankfurters, lunch meat, etc. by packing the product into 55 gal. drums having plastic liners and transporting the drums in refrigerated trucks. Bulk transport of such material has been impractical because it has been too difficult to load and unload large tanks with the product and to sterilize the tanks, due, in part, to the excessive time involved in doing so.

Bulk transport of transformer oil, on the other hand, has not been uncommon, but because of the sensitivity of the oil to water and humid air, it has been very troublesome. Transformer oil may only be loaded into and unloaded from conventional tank trucks during conditions of low humidity and dryers must be installed on the truck to permit venting only of dry air. Because transformer oil must be kept absolutely dry, transformer oil should be totally sealed from ambient air when it is loaded, transported, and unloaded so that it can be transported regardless of weather conditions.

SUMMARY OF THE INVENTION

Among the several objects of the invention may be noted the provision of a tank for transport and storage of semi-solid or fluid materials which has a movable piston or follower with an improved self-cleaning action; the provision of such a tank which is easy to sterilize, thereby to allow food products to be transported therein; the provision of such a tank which insures total sealing of the contents from ambient air, thereby permitting the transport of materials, such as transformer oil, that must be kept absolutely dry; the provision of such a tank which is reliable in operation and relatively simple and inexpensive in construction; and the provision of such a tank which has a piston that is relatively easy to assemble and insert into the tank.

Generally, this invention relates to an elongate tank for transport or for storage in bulk of semisolid and fluid materials, such as grease and oil. The tank is of generally cylindric internal cross section, and has an outlet for the material contained therein at one end thereof. It has a generally cylindric piston sized to slide therein, which is adapted to be moved in a direction toward the outlet, thereby forcing the material in the tank through the outlet. An elastic annular seal is carried in a circumferential channel around the piston adjacent one end of the piston. The seal is hollow and expandable and has pressurizing means for varying the pressure within the seal between atmospheric pressure and a pressure higher than atmospheric wherein the seal expands and presses against the internal surface of the tank with the pressure such that when the piston slides in the tank the seal is maintained in sliding engagement with the internal surface thereby to wipe the material therefrom and to seal the piston relative to the tank. The piston has means for holding it against canting in the tank comprising a plurality of pads fastened to the piston and extending radially outwardly therefrom beyond the periphery of the piston for engagement with the internal surface of the tank. The pads are of low friction material to permit the piston to slide freely in the tank, and they are spaced axially of the piston from the seals a distance sufficient to prevent canting of the piston.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figures 1, 2, 3:
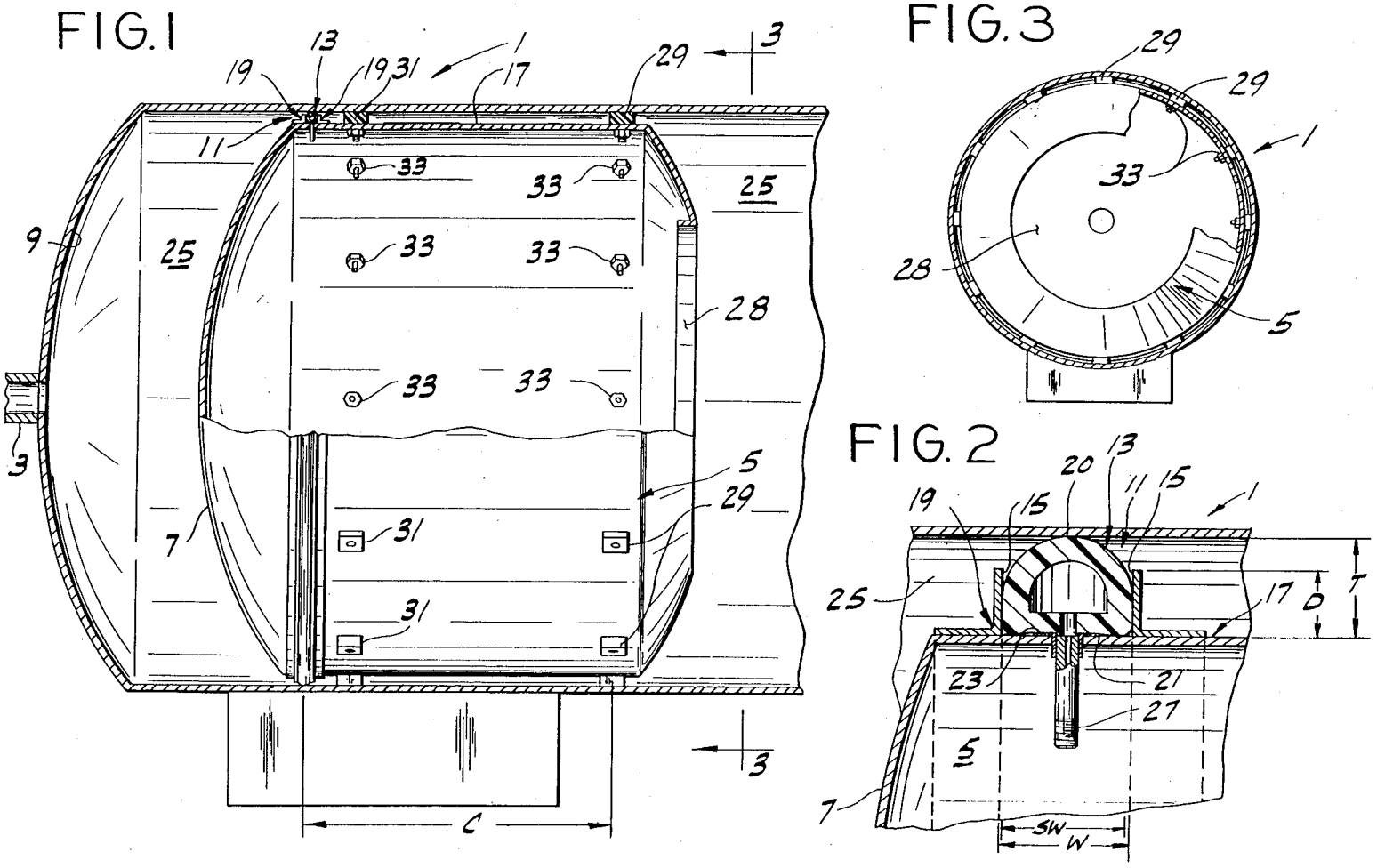
FIG. 1 is a longitudinal cross-section of the end portion of a tank of the present invention, showing a piston, partially broken away to illustrate details, movable within the tank.
FIG. 2 is an enlarged view of the section indicated at 2 in FIG. 1 showing an elastic hollow seal in a channel circumferentially around the piston.
FIG. 3 is a cross-sectional view on a reduced scale along 3—3 of FIG. 1 illustrating an arrangement of pads on the piston.

Referring to the drawings, an elongate tank of the present invention is designated in its entirety by the reference numeral 1. As shown in FIG. 1, the tank has a combination inlet and outlet port 3 at one end (hereinafter designated the forward end for convenience only) for filling and emptying the tank with semisolid material, such as grease, or fluid material, such as oil.

Tank 1 is of generally cylindric internal cross section throughout its length. A tank designed to be carried on a semitrailer, for example, may have an internal diameter of approximately 68" (1730 mm) and a length of 42 ft. (12.8 m). It has a generally cylindric piston generally designated 5 sized to slide therein, and which may be moved in a direction toward the port 3, designated the forward direction (left in FIG. 1), to force the semisolid or fluid material in the tank through the port. For example, the piston may be moved by increased air pressure on its rearward side (right in FIG. 1). The piston 5 may be moved in the rearward direction (right in FIG. 1) either by pumping the material into port 3 or by creating a subatmospheric pressure on the rearward side of piston 5 to draw semi-solid or fluid material into the tank through the port 3.

The piston 5 has a head 7 at its forward end, which is preferably configured for complementary engagement with the interior contour 9 of the forward end of tank 1, so that the contained material may be efficiently and completely forced through the outlet (i.e. when the piston head comes into contact with the forward end, no substantial amount of the material is left in the tank). For example, the head 7 of the piston may be convex and the complementary interior contour 9 of the forward end of the tank 1 may be concave.

Piston 5 has a circumferential channel 11 therearound adjacent one end thereof in which is carried an elastic annular seal 13. Channel 11 is formed between retaining walls 15 projecting from the outer surface 17 of the piston 5. Specifically, two retaining rings (or angles) designated generally as 19 are spaced apart a distance W (e.g., 2 in. (51 mm)) sufficient to receive the seal 13 and mounted to the piston (e.g., by welding, bolts, screws, etc.).

Seal 13 is hollow and expandable, and is formed of unreinforced synthetic rubber, such as a Buna-N (nitrile) rubber having a hardness, for example, of approximately 65 durometer (Shore A scale). As shown in FIG. 2, seal 13 is generally D-shaped in cross-section with the outer surface 20 being generally arcuate in shape and the inner surface 21 generally linear in cross-section to contact the outer surface 17 of the cylindrical piston 5 across the bottom 23 of the channel 5. The walls of the seal 13 forming the outer and inner surfaces, 20 and 21, respectively, are sufficiently thick (e.g., $\frac{3}{8}$ in. (10 mm) for a seal having an overall thickness T of $1\frac{5}{8}$ in. (41 mm) when unexpanded) and strong so that when the seal is pressured it will expand to firmly and completely contact the interior surface of the tank around its entire periphery.

Preferably, the depth D of the channel is a substantial portion (e.g., 50–60%) of the thickness T of the seal's cross-section, thereby preventing the seal from expanding longitudinally of the piston 5 and directing the expansion of the seal in the radially outward direction so that the seal may be expanded against the internal surface 25 of the tank. In addition, the seal 13 should have a thickness T that is sufficiently greater than the depth D of the channel so that the channel does not interfere with the ability of the seal to accommodate for variations in the internal diameter of the tank and imperfections, such as out of round areas of the tank and dents or "dings", etc., in the internal surface 25 of the tank. Of course, the preferred sizes of the seal 13 and channel 11 change according to the internal diameter of the tank. In a tank having a large (50–80 in. (1270–2340 mm)) internal diameter, the thickness T of the seal 13 may be $\frac{1}{2}$ in. (13 mm) or more greater than depth D of the channel (e.g., a depth D of 1 in. (25 mm) and a thickness T of $1\frac{5}{8}$ in. (41 mm) for a 68 in. (1730 mm) internal diameter tank).

The seal 13 has pressurizing means 27 for varying the pressure within the seal between atmospheric pressure and a pressure higher than atmospheric (e.g., 10–14 psig (69–97 kPa gage)). As shown in FIG. 3, pressurizing means 27 includes a normally closed valve 27 openable for pressurizing and depressurizing the seal. An opening 28 is provided at the rear end of the piston 5 for access to the valve 27. When pressurized, the seal 13 expands and presses against the internal surface 25 of the tank with the pressure such that when the piston 5 slides in the tank the seal is maintained in sliding engagement with the internal surface thereby to wipe the material therefrom and to seal the piston relative to the tank.

The width SW of the seal 13, when at atmospheric pressure, is substantially that of the width W of the channel so that the seal is prevented from expanding longitudinally of the piston and will expand radially outwardly against the internal surface 25 of the tank when pressurized to higher pressures. In addition, the width SW of the seal 13 is preferably somewhat greater than the thickness T of the unexpanded seal and is D-shaped in cross-section further insuring that it will be stable in the channel as the piston 5 moves through the tank. For example, the thickness T of the seal at atmospheric pressure may be $1\frac{5}{8}$ in. (41 mm) while the width SW of the seal and the width W of the channel 11 may be approximately 2 in. (51 mm) for a tank having an internal diameter of approximately 68" (1730 mm).

Preferably, seal 13 has an unexpanded configuration at atmospheric pressure wherein the outside diameter of the seal is slightly less than the internal diameter of the tank to facilitate insertion of the piston 5 in the tank. The seal 13 is inflatable, when pressurized, from the unexpanded configuration to an expanded configuration wherein the seal expands against the internal surface 25 of the tank thereby wiping the material from the internal surface of the tank when the piston 5 slides within the tank and sealing the piston relative to the tank. While the seal may be pressurized at pressures of up to 30 psig (207 kPa gage) or more, typically the seal is inflated or pressurized to 10–12 psig (69–83 kPa gage) to expand it for sealing the piston 5 relative to the tank.

The outer diameter of the seal 13 when unexpanded may also be substantially the same as the internal diameter of the tank, in which case the seal 13 would be collapsible when the valve 27 is open to facilitate insertion of the piston 5 into the tank. Seal 13 may then be pressurized so that it presses against the internal surface 25 of the tank to wipe material therefrom and to seal the piston 5 relative to the tank.

It will be observed that a significant advantage of the seal 13, whether it is inflatable from an unexpanded configuration to an expanded configuration, or collapsible when the valve 27 is open, or both, is that it allows the piston to be inserted easily into the tank. Other designs, such as a solid neoprene or rubber O-ring design conceived and tested during development of seal 13, do not facilitate inserting a piston into the tank. Installing the solid rubber O-ring seal involved a considerable amount of labor, and required come-alongs, bars and sledge hammers to insert the piston into the tank, none of which are required to insert the piston 5 having the expandable seal 13 into the tank.

The piston 5 is held against canting in tank 1 by a plurality of pads 29, 31 fastened (e.g., by bolts 33 having recessed heads) to the piston and extending radially outwardly therefrom beyond the periphery of the piston for engagement with the internal surface 25 of the tank. The pads are of low friction material (e.g., nylon), thereby permitting the piston to slide freely in the tank. The pads have a thickness (radially of piston) somewhat less than one-half of the difference between the diameter of the piston and the internal diameter of the tank. For example, if the diameter of the piston is approximately 64 inches (1630 mm) and the internal diameter of the tank approximately 68 inches (1730 mm), than the thickness of each pad is approximately 1½ inches (38 mm). Also, the pads may be approximately 3 inches (76 mm) long (axially of piston) and 1½ inches (38 mm) wide (circumferentially of piston). The nylon pads 29, 31 may be trimmed by a file or sand paper to ensure that the piston moves freely back and forth.

As shown in FIG. 1, pads 29 are spaced axially of the piston 5 from the seal 13 a distance C sufficient to prevent canting of the piston (e.g., adjacent the rearward end of the piston). For example, the pads may be arranged in one circumferential row (i.e. pads 29) around the periphery of the piston, or they may be arranged in two circumferential rows (i.e. pads 29 and 31) around the periphery of the piston wherein the second row of pads (i.e. pads 31) are generally adjacent seal 13. As shown in FIG. 3, each pad may be spaced within its row at approximately uniform distances from the nearest other pads (e.g., at 30 degree intervals around the circumference of the piston). While two rows of pads are preferred, other arrangements are possible which also prevent canting of the piston 5.

Variations in internal diameter of the tank of ¼ inch (8 mm) or more in a large tank may be accommodated by the pads 29, 31 and seal 13 of this design without substantially reducing the wiping and sealing action of the seal. It will be observed in this regard that the expandable seal 13 is capable of accommodating significantly greater changes in internal diameter of the tank, out-of-roundness of the tank and imperfections in the internal surface of the tank than the solid rubber O-ring or molded flexible neoprene seals discussed above. Thus the unreinforced and pressurized seal 13 will apply substantially even pressure to the internal surface of a tank even when the tank is out-of-round, dinged or when it has a varying internal diameter.

In operation, air pressure on the rearward side of the piston may be increased by introducing compressed air, causing piston 5 to move forward inside the tank, and thereby forcing semisolid or fluid material through outlet 3. The seal 13 wipes the semisolid or fluid material from the internal surface 25 of the tank, thereby causing the tank to be self-cleaning in operation, and the pads 29, 31 hold the piston against canting, thereby preventing jamming and allowing the piston to move at an even speed. Semisolid or fluid material is loaded into the tank by pumping it into port 3 thereby moving the piston rearwardly (to the right in FIG. 1) and/or by drawing it through outlet 3 by moving the piston 5 rearwardly. Fluid materials, such as wastewater, and even semisolid materials, such as grease, have been drawn into the tank by creating a partial vacuum in the tank rearwardly of the piston 5.

It will be observed that one particular advantage of the tank 1 is its ability to handle food products, such as ground food products (e.g., ground chicken parts). To prepare the tank 1 for food product, the interior of the tank and the head 7 of piston 5 are steam cleaned by 800 psig (5,500 kPa gage) steam while the piston is positioned at the rear end of the tank (to the right in FIG. 1), thereby sterilizing the interior of the tank, the head 7 of the piston and the seal 13 so that food products may be carried. In addition, the piston 5 is easily removed from the tank for cleaning, when more than steam cleaning is desired, and then inserted back into the tank because the seal 13 is collapsible when the valve 27 is open and/or because the outer diameter of the unexpanded seal is less than the internal diameter of the tank.

It will be observed from the foregoing that the piston is easily installed in the tank, self-cleaning, and improved in performance.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In an elongate tank for transport or for storage in bulk of semisolid and fluid materials, such as grease and oil, said tank having an outlet at one end thereof for the material contained therein, said tank being of generally cylindric internal cross-section; a generally cylindric piston sized to slide in the tank and adapted to be moved in a direction toward said outlet thereby to force material in the tank through the outlet, said piston having a circumferential channel therearound adjacent one end thereof, said channel carrying an elastic annular seal therein, said seal being hollow and expandable and having pressurizing means for varying the pressure within the seal between atmospheric pressure and a pressure higher than atmospheric wherein the seal expands and presses against the internal surface of the tank with the pressure such that when the piston slides in the tank the seal is maintained in sliding engagement with the internal surface thereby to wipe the material therefrom and to seal the piston relative to the tank, and means for holding the piston against canting in the tank comprising a plurality of pads fastened to said piston and extending radially outwardly therefrom beyond the periphery of the piston for engagement with the internal surface of the tank, said pads being of low friction material to permit said piston to slide freely in said tank, said pads being spaced axially of the piston from said seal a distance sufficient to prevent canting of the piston.

2. In a tank as set forth in claim 1, the width of the seal when at atmospheric pressure being substantially that of the width of the channel.

3. In a tank as set forth in claim 2, the depth of the channel being a substantial portion of the thickness of the seal's cross-section.

4. In a tank as set forth in claim 1, the seal being generally D-shaped in cross-section with the outer surface being generally arcuate in shape and the inner surface generally linear in cross-section to contact the outer surface of the cylindrical piston across the bottom of the channel.

5. In a tank as set forth in claim 1, the seal being formed of unreinforced synthetic rubber.

6. In a tank as set forth in claim 1, said pressurizing means includes a normally closed valve openable for pressurizing and depressurizing the seal.

7. In a tank as set forth in claim 6, said seal being collapsible when the valve is open thereby to facilitate insertion of said piston in said tank.

8. In a tank as set forth in claim 6, said seal being inflatable, when pressurized, from an unexpanded configuration at atmospheric pressure wherein the outside diameter of the seal is slightly less than the internal diameter of the tank thereby facilitating insertion of said piston in said tank, to an expanded configuration wherein the seal expands against the internal surface of the tank thereby wiping the material from the internal surface of the tank when the piston slides within the tank and sealing the piston relative to the tank.

9. In a tank as set forth in claim 1, said pads being arranged in at least one circumferential row around the periphery of the piston, said row of pads being spaced axially of the piston from said seal a distance sufficient to prevent canting of the piston, each pad being spaced within its row at approximately uniform distances from its adjacent pads.

10. In a tank as set forth in claim 9, said pads being arranged in at least two circumferential rows around the periphery of the piston, a first row of pads spaced axially of the piston from said seal a distance sufficient to prevent canting of the piston, and a second row of pads being generally adjacent said seal.

11. In a tank as set forth in claim 10, said pads being formed of nylon.

12. In a tank as set forth in claim 1, said piston having a head at said one end thereof, said head being configured for substantial complementary engagement with the interior contour of said one end of the tank whereby material in the tank may be substantially completely forced through said outlet to empty the tank.

13. In a tank as set forth in claim 12, said head of the piston being convex and the interior contour of said one end of the tank being concave.

* * * * *